US005601058A

United States Patent [19]

Dyches et al.

[11] Patent Number: 5,601,058

[45] Date of Patent: Feb. 11, 1997

[54] STARTING APPARATUS FOR INTERNAL COMBUSTION ENGINES

[75] Inventors: Gregory M. Dyches, Barnwell, S.C.; Aed M. Dudar, Augusta, Ga.

[73] Assignee: The United States of America as represented by the Department of Energy, Washington, D.C.

[21] Appl. No.: 399,347

[22] Filed: Mar. 6, 1995

[51] Int. Cl.[6] ..... F02N 11/08

[52] U.S. Cl. ..... 123/179.2; 123/179.3; 290/38 C

[58] Field of Search ..... 123/179.2, 179.3, 123/179.4; 290/38 R, 38 C

[56] References Cited

U.S. PATENT DOCUMENTS

| | | | |
|---|---|---|---|
| 2,367,960 | 1/1945 | Parfitt | 123/179.2 |
| 3,530,846 | 9/1970 | Bean et al. | 123/179 |
| 3,603,802 | 9/1971 | Petric | 290/37 |
| 3,657,720 | 4/1972 | Avdenko et al. | 343/225 |
| 3,788,294 | 1/1974 | Logan | 123/179 BG |
| 3,859,540 | 1/1975 | Weiner | 290/38 |
| 4,198,945 | 4/1980 | Eyermann et al. | 123/179.3 |
| 4,227,588 | 10/1980 | Biancardi | 180/167 |
| 4,236,594 | 12/1980 | Ramsperger | 180/167 |
| 4,446,460 | 5/1984 | Tholl et al. | 340/825.69 |
| 4,577,599 | 3/1986 | Chmieleski | 123/179 B |
| 4,674,454 | 6/1987 | Phairr | 123/179 |
| 4,947,051 | 8/1990 | Yamamoto et al. | 123/179.3 |
| 5,054,569 | 10/1991 | Scott et al. | 180/167 |

FOREIGN PATENT DOCUMENTS

| | | | |
|---|---|---|---|
| 61-192849 | 8/1986 | Japan | 290/38 R |
| 4-91370 | 3/1992 | Japan | 290/38 R |

*Primary Examiner*—Andrew M. Dolinar

*Attorney, Agent, or Firm*—Harold H. Dixon; William R. Moser; Paul A. Gottlieb

[57] ABSTRACT

An internal combustion engine starting apparatus uses a signal from a current sensor to determine when the engine is energized and the starter motor should be de-energized. One embodiment comprises a transmitter, receiver, computer processing unit, current sensor and relays to energize a starter motor and subsequently de-energize the same when the engine is running. Another embodiment comprises a switch, current transducer, low-pass filter, gain/comparator, relay and a plurality of switches to energize and de-energize a starter motor. Both embodiments contain an indicator lamp or speaker which alerts an operator as to whether a successful engine start has been achieved. Both embodiments also contain circuitry to protect the starter and to de-energize the engine.

19 Claims, 2 Drawing Sheets

100
110
IC
TIMER 1
(2 SECONDS)
120
RESET
150
CURRENT
TRANSDUCER
VOLTAGE
RC
160
LOW-PASS
FILTER
IC
170
GAIN/
COMPARATOR
IC
140
RESET
TIMER 2
(8 SECONDS)
145
130
STARTER
MOTOR
180
PRESET
CURRENT
THRESHOLD
STARTER
RELAY

OFF
RUN
200
START
202
206
204
STARTER
MOTOR

OFF
RUN
200
START
208

202
210
206
204
STARTER
MOTOR

STARTING APPARATUS FOR INTERNAL COMBUSTION ENGINES

BACKGROUND OF THE INVENTION

1. Field of the Invention

The present invention relates generally to an apparatus for starting internal combustion engines. Specifically, the present invention is a starting apparatus that energizes a starter motor and then de-energizes the starter motor once the internal combustion engine begins running. The United States Government has rights in this invention pursuant to Contract No. DE-AC09-89SR18035 between the U.S. Department of Energy and Westinghouse Savannah River Company.

2. Discussion of Background

In a typical internal combustion engine, there is a starter motor that is activated by turning the ignition key momentarily until the starter motor causes the engine to start. The starter motor has a flywheel that turns the crankshaft of the engine. As the crankshaft is turned, the pistons connected to the crankshaft compress the air in each of the cylinders in succession. Meanwhile, an air/fuel mixture enters each cylinder and a spark is delivered to the sparkplugs of the cylinder to ignite the mixture. Once the cylinders are all firing, and the engine is running, the starter motor is deactivated. When the internal combustion engine is to be stopped, a signal is sent to the engine's magneto to discontinue the delivery of the voltage to the sparkplugs.

Unfortunately, the starting of the engine is based on hearing it operate. The user knows when the engine has been started by the sound of it running. However, there are occasions when the user cannot hear well enough or not at all. For example, in noisy environments the engine sound may be drowned out by the noise. If the operator has a hearing impairment, the sound of the engine may be inaudible. Also, there are circumstances when an engine might be started remotely. In these circumstances, there is no one present to listen for the engine sound.

There exists in the art a variety of starting apparatus for internal combustion engines. These apparatus typically monitor a particular engine variable until it indicates that the engine has started and then de-energize the starter motor. What follows is a brief review of the art's current state.

One class of device monitors engine speed to determine whether the engine has started, or to regulate its operation. Representative of this class is Chmielewski (U.S. Pat. No. 4,577,599) and Avdenko, et al. (U.S. Pat. No. 3,657,720). Chmielewski mounts a sensing coil adjacent to the flywheel, and reinitiates cranking when the engine speed fails to reach a predetermined level after a predetermined cranking period. Avdenko, et al. monitor the generator output to determine when the engine is turning over at a higher number of revolutions per minute (RPM) than the maximum cranking RPM. Their device stops the engine if running, and starts the engine if stopped.

Several devices teach voltage measurement as a means of controlling the operation of a combustion engine. Chmielewski, Avdenko, et al., and Bean, et al. (U.S. Pat. No. 3,530,846) monitor the generator output voltage to determine engine condition. Ramsperger (U.S. Pat. No. 4,236,594), Biancardi (U.S. Pat. No. 4,227,588), and Weiner (U.S. Pat. No. 3,859,540) monitor the voltage across the alternator, regulator and ignition coil, respectively. Ramsperger energizes the starter motor for a predetermined number of seconds, and checks the status of a relay that is energized by the alternator output to verify that the engine is running. If the engine has not started, the starter motor is re-energized a predetermined number of times, with a predetermined delay between each energizing. Weiner monitors the ignition coil voltage (zero when the engine is off, intermediate during cranking, and higher while the engine is running). Finally, Biancardi opens a switch to disconnect the starter solenoid once the voltage in the regulator stator equals the battery voltage.

The engine oil pressure is used by Tholl, et al (U.S. Pat. No. 4,446,460) and Weiner, both of whom shut off the starter motor once the oil pressure reaches its operating level.

Scott, et al (U.S. Pat. No. 5,054,569), Phairr (U.S. Pat. No. 4,674,454), Parfill (U.S. Pat. No. 2,367,960) and Petric (U.S. Pat. No. 3,603,802) all teach the use of engine vacuum as a means of determining engine status. These designs employ vacuum-activated switches that operate to deactivate the starter motor once the engine is running. Scott, et al. use a microcomputer-based circuit and digital command signals; Parfill connects a vacuum-operated switch to the engine induction pipe, arranged to open the starting motor relay when the engine starts to turn. The Phairr device operates the starter motor for a predetermined period, and, if the engine fails to start, it automatically makes a second attempt to start the engine.

Prior art devices measure engine status using indicators that are somewhat indirect, that is, variables not associated with the status of the starter motor itself. As a result, many of the parameters used by the prior art vary due to extrinsic factors, and therefore erroneous readings are common. For example, the vacuum generated by a running engine may change if there is a leak, and consequently, a device that senses engine vacuum may attempt to restart the engine, causing electrical and mechanical damage. The problems caused by measuring indirect indicators decrease the efficiency and accuracy of combustion engine starters.

Therefore, there is a need for a starter which accurately monitors a simple, direct variable to determine accurately the operating status of an internal combustion engine.

SUMMARY OF THE INVENTION

According to its major aspects and briefly recited, the present invention is an apparatus for starting an engine that has an electric DC starter motor. In its simplest embodiment, the apparatus controls the starter motor by means for activating the starter motor and means tied electrically to the activating means and the starter motor for sensing electrical current drawn by the starter motor. The sensing means issues to the activating means a voltage signal related to the electrical current drawn by the starter. The activating means in turn issues an output signal when that voltage signal indicates that the electrical current is at a value selected to indicate that the engine has started. The output signal can be used by the device to de-energize the starter motor and to drive a display indicating whether the engine has started or not.

In a preferred embodiment, the apparatus includes a transmitter for the user to send a start and a stop engine signal by radio frequency to a receiver connected to the activating means so that the starter motor can be started remotely and the engine can be stopped remotely. Also, to protect the engine and starter motor, timers are used to limit the time the starter motor cranks the engine and the time it takes the starter motor to draw sufficient current to start the engine.

Monitoring the current in the starter motor as a means to determine whether an engine has started is a major feature of the present invention. Starter motor current is a simple, robust variable that can be easily and inexpensively monitored with a transducer such as a coil. Moreover, the current in the starter motor is a direct variable and therefore not as easily affected by extrinsic factors, i.e., changes in the engine's environment or design. Consequently, there is less potential for erroneous and inaccurate readings.

Another important feature of the present invention is the current-monitoring sensor that enables a remote indication of when the engine has started. The advantage of monitoring the current, rather than listening for the sound of a started engine, is that it allows the device to be operated remotely and the status of the engine to be displayed visually or by sounds audible to the user. Normally, a starter motor, the engine and the user are in sufficient proximity to allow the user to hear the combustion engine energize, at which time the user de-energizes the starter motor. However, in many technological and industrial applications, the engine is spaced a distance from the control console, and thus one cannot hear the engine engage. By monitoring the current level in the starter motor, an engine can be quickly and easily activated and de-activated in a remote location without relying upon the user's ability to hear the engine.

Another feature of the present invention is the light or audible alarm employed by a preferred embodiment of the present invention. People who are hearing impaired often have difficulty in starting a vehicle, because they cannot hear the motor running and therefore do not know when to de-activate the starter motor. In addition, many hearing impaired individuals erroneously believe that the engine is not energized, when in fact it is. Consequently, these individuals often reengage the starter motor when the engine has started. This act can damage both the starter motor and the engine. By providing a light or an alarm that indicates when the engine is on, a hearing impaired individual can safely and easily start a vehicle.

Still another feature of the present invention is the integration of the circuitry contained in a preferred embodiment. Because of the electrical design, the present invention can easily be added to an existing engine, or built into the starter, without disturbing other engine components.

Other features and advantages will be apparent to those skilled in the art from a careful reading of the Detailed description of a preferred embodiment accompanied by the following drawings.

DETAILED DESCRIPTION OF A PREFERRED EMBODIMENT

Figure 1:
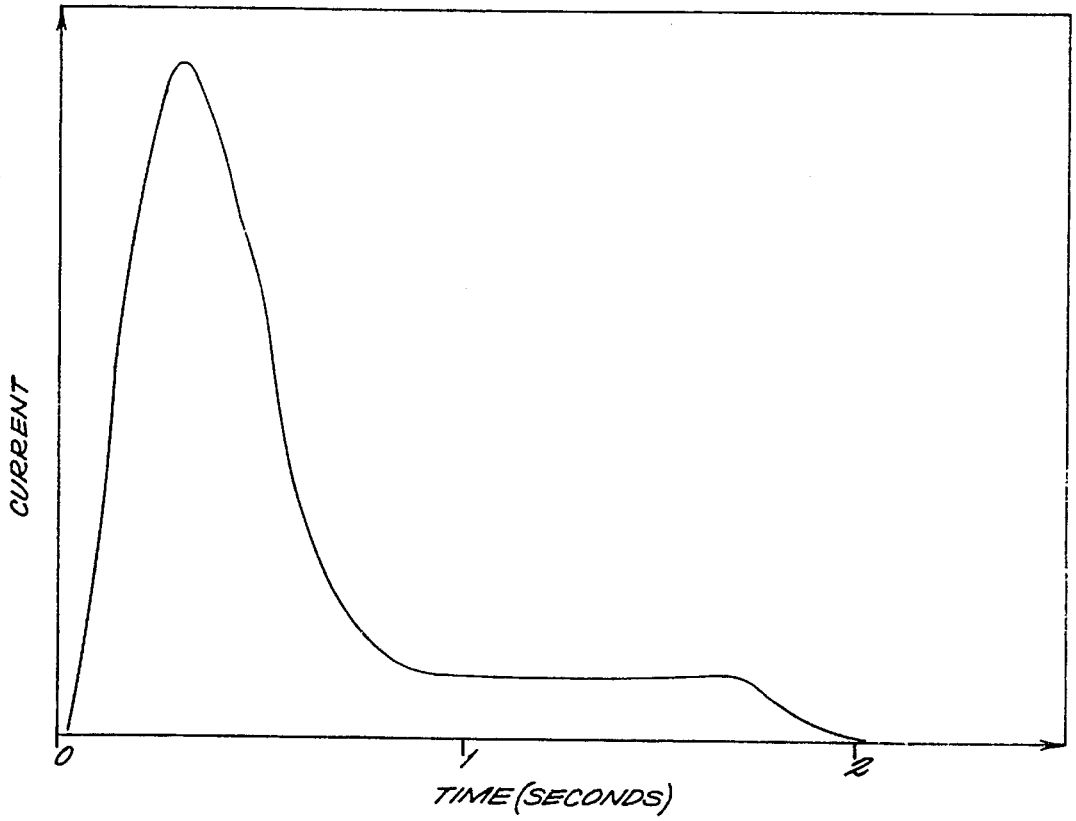
FIG. 1 is a current v. time profile of a starter motor when starting an internal combustion engine.
Figure 2:
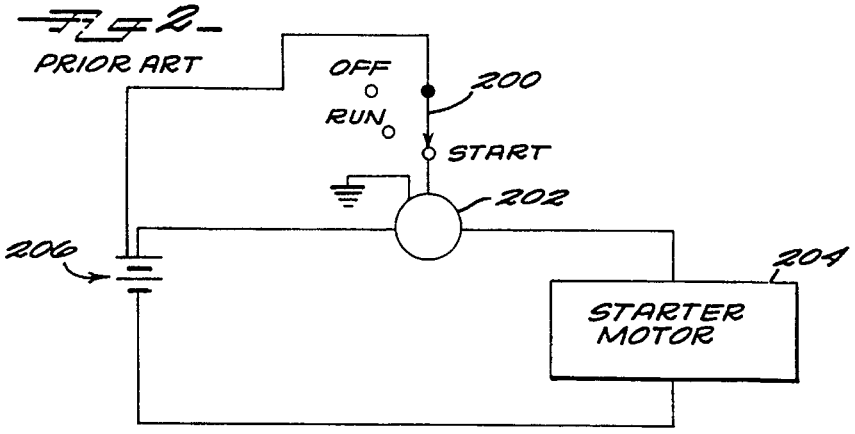
FIG 2 PRIOR ART
FIG. 2 illustrates the prior art starter system.

The graphical depiction of the current drawn by a starter motor to energize an internal combustion engine can be seen in the current v. time profile of FIG. 1, and the prior art starter system is illustrated in FIG. 2. The term "energize", as used in this reference, means to actuate by supplying energy thereto. As can be seen in FIGS. 1 and 2, when the starter motor is initially engaged by turning momentarily a three position ignition switch 200 from the "off" position to "start" to close a starter solenoid switch 202 allowing current to flow to starter motor 204 from battery 206, a sharp increase in current occurs in order to overcome the inertia of the engine's flywheel. The current then decreases to a plateau value of between 30 to 75 amps. During this time, the starter motor is engaging the engine's flywheel and causing it to turn. When the engine finally starts, current output decreases to a value in the range of 0–15 amps. This decrease in current value is due to the fact that the engine's flywheel is running off the engine's internal combustion process and not the starter motor. At this point, an operator de-energizes the starter motor by allowing three-position ignition switch 200 to return to the "run" position. The value of the peak current and the duration of the plateau region will vary based upon the size of a given internal combustion engine (four cylinder, six cylinder, etc.). However, the general shape of this current v. time relationship will remain the same for different combustion engines.

The present invention is a starting apparatus for an internal combustion engine that monitors the level of the current in a starter motor to determine whether an engine has successfully started. When the current decreases to a preselected value, the apparatus de-energizes the starter motor. The device does not rely on a human operator and can be applied to any size, shape or kind of internal combustion engine.

Figure 3:
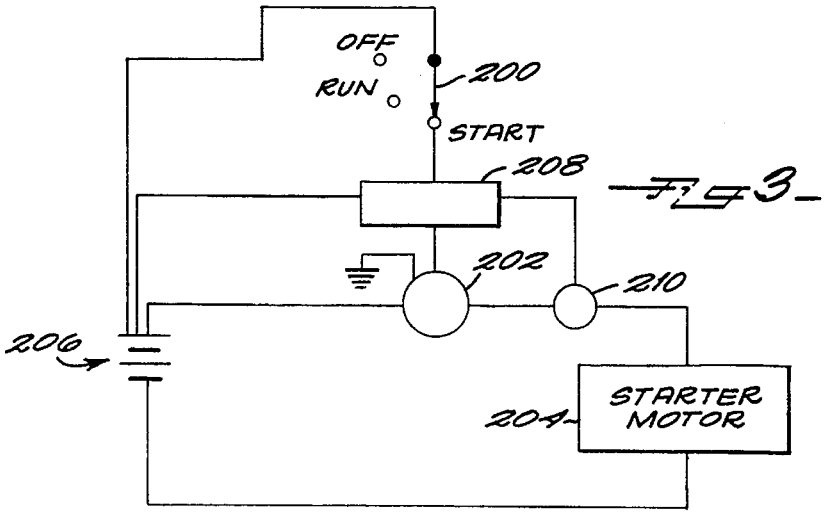
FIG. 3 illustrates the integration of a starter apparatus according to a preferred embodiment of the present invention with the prior art starter system.

By comparing FIG. 2 to FIG. 3, one may see that the present invention can be added to an existing starter motor system by simply incorporating an integrated circuit controller 208 between three-position ignition switch 200 and solenoid switch 202 and a current sensor 210 between solenoid switch 202 and starter motor 204.

Figure 4:
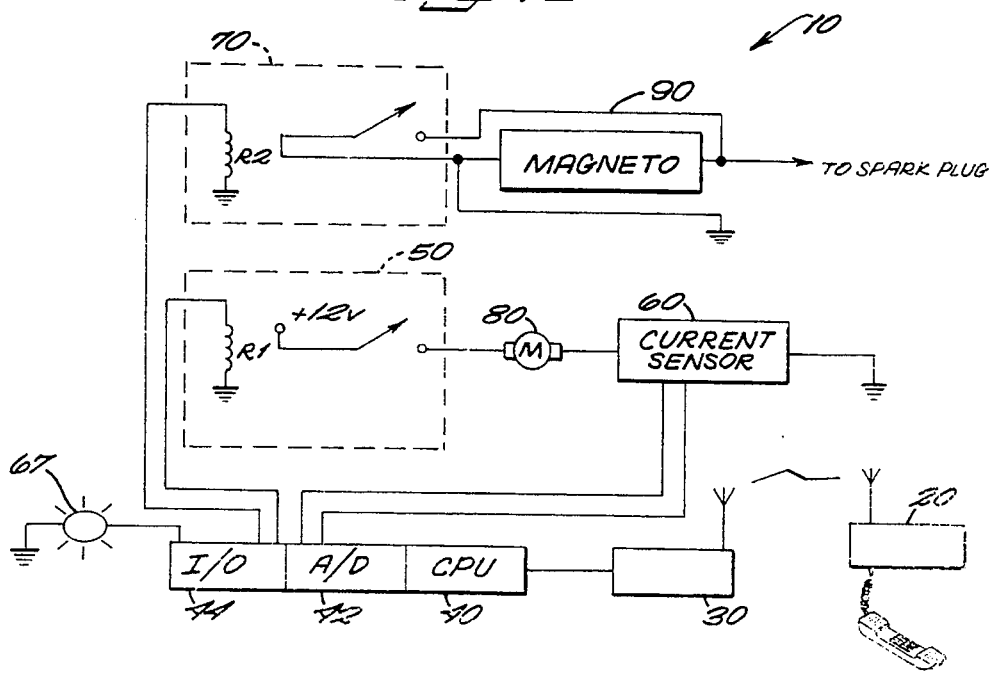
FIG. 4 is an electrical schematic diagram of a starting apparatus according to a preferred embodiment of the present invention.

Referring to FIG. 4, there is shown an electrical diagram of a preferred embodiment of the present starting apparatus, generally indicated by reference numeral 10. Starting apparatus 10 comprises a transmitter 20, receiver 30, computer processing unit (CPU) 40, first relay 50, current sensor 60, and second relay 70. In electrical connection with CPU 40 is an analog to digital (A/D) converter 42 and input/output (I/O) port 44. Both A/D converter and I/O port 44 electrically condition the signals issued by CPU 40. Transmitter 20 is in radio communication with receiver 30, preferably mounted in a control console with CPU 40, which allows the remote operation of starting apparatus 10.

Operation of starting apparatus 10 begins by sending a signal from transmitter 20 to receiver 30 which is passed electrically to CPU 40. CPU 40 accepts the signal from receiver 30 and subsequently activates first relay 50 with which it is in electrical connection. At this time, first relay 50 closes to complete the circuit and starter motor 80 begins to crank the engine. First relay 50 is preferably an interval-on, time delay relay, meaning that it is in the "on" or closed position for a preselected interval of time before it returns to the "off" or open position. Therefore, if starter motor 80 fails to start the internal combustion engine within a pre-determined time period, first relay 50 will de-energize starter motor 80 by opening the circuit. Thereafter, the sequence of operations, i.e., a signal from transmitter 20, will be needed to begin again to reactivate starter motor 80. Thus, first relay 50 protects starter motor 80 from being damaged in the event the engine fails to start within a reasonable interval of time.

When starter motor 80 is energized, current sensor 60 begins to sense the current drawn by starter motor 80. Current sensor 60 is also in electrical connection with CPU 40, such as by the use of electrical wiring. CPU 40 is programmed to monitor the current drawn by starter motor 80. When CPU 40 detects that starter motor 80 is drawing an electrical current that has fallen to or below a certain preselected current level, indicating that the engine has been successfully started (between 0 and 15 amps for typical combustion engines), CPU 40 issues a signal which activates indicator 67 and opens first relay 50, thereby terminating the operation of starter motor 80.

De-activation of the internal combustion engine can also be accomplished remotely by sending the appropriate signal from transmitter 20 to receiver 30 and CPU 40. CPU 40 then issues a signal to second relay 70. Upon receipt of such signal, second relay 70 opens the circuit leading to, and thereby de-energizes, an engine magneto 90. Magneto 90 provides the "spark" to the combustion mixture through spark plugs in the engine, without which there can be no combustion reaction and the engine stops functioning.

Figure 5:
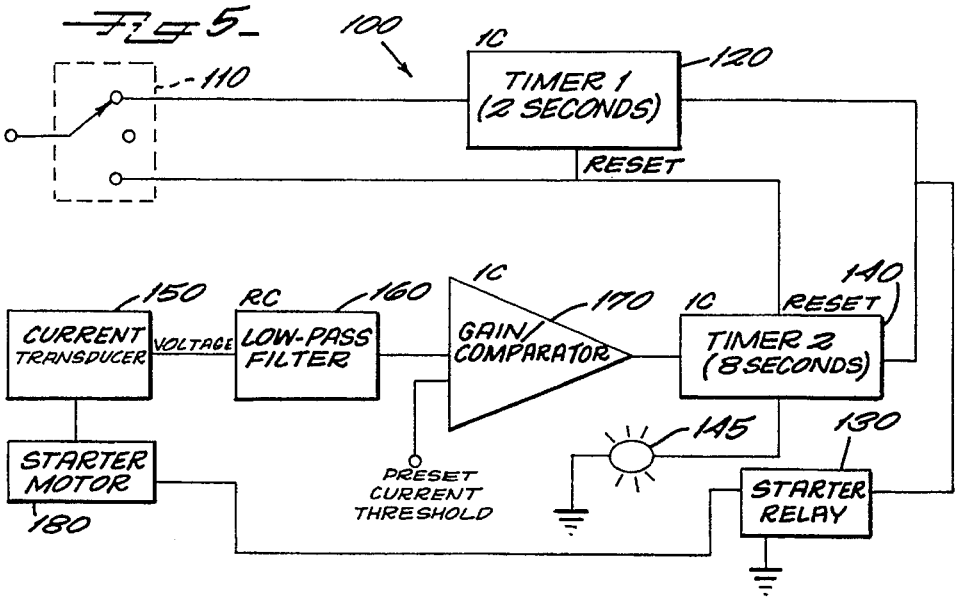
FIG. 5 is an electrical schematic diagram of a starting apparatus according to an alternative preferred embodiment of the present invention.

Referring now to FIG. 5, there is shown an electrical diagram of a alternative preferred embodiment of the present starting system generally indicated by reference numeral 100. Starting system 100 comprises a switch 110, a first timer 120, a starter relay 130, a second timer 140, an indicator 145, a current transducer 150, a low-pass filter 160 and a comparator 170.

The operation of starter 100 begins when switch 110 is turned to the "start" position from the "off" position. In response, switch 110 issues a signal to trigger first timer 120. First timer 120 then closes starter relay 130 to activate starter motor 180. First timer 120 remains activated for a predetermined period of time, preferably two seconds, before resetting. Once the electrical current drawn by starter motor 180 exceeds a certain preselected value, indicating that the engine is cranking, second timer 140 is triggered. Second timer 140 is in electrical connection with starter relay 130, and keeps relay 130 closed as long as second timer 140 is triggered.

Once starter motor 180 is energized, current transducer 150 generates a voltage signal that is an analog of the electrical current drawn by starter motor 180. Thereafter, the voltage signal is filtered by low-pass filter 160. Low-pass filter 160 serves to eliminate any short duration, high frequency current spikes that may occur during a "false start" of the engine, i.e., a momentary spark firing. Low-pass filter 160 may be a simple resistor-capacitor circuit as is well known in the electrical arts. The voltage signal is then compared by a comparator 170 to a preselected voltage corresponding to the current drawn by starter motor 180 when an engine is running (normally between 0 and 15 amps). If the voltage signal from transducer 150 is less than or equal to the preselected voltage, comparator 170 issues a signal to second timer 140. Upon receipt of such signal, second timer 140 de-energizes starter relay 130 to open the circuit and energizes indicator 145, which is preferably a visual and/or audible indicator that the engine is running. Indicator 145 may indicate only that the engine has failed to start, only that engine has started, or may be capable of indicating both. The preset current threshold should be set to deactivate relay 130 at approximately one half the normal current load, which value would be approximately the same for a variety of engine sizes.

If not reset by comparator 170, second timer 140 will remain activated for a preselected period of time, preferably about eight seconds. At the end of that time period, second timer 140 will deactivate and thereby de-energize starter relay 130 and reset starter system 100. This function serves to prevent a battery discharge or possible starter motor damage in the event the engine fails to start.

In this embodiment, the combustion engine can be de-activated by turning switch 110 to the "off" position. This action causes the reset of first timer 120 and second timer 140, which both act to de-energize starter relay 130, thereby opening the circuit and stopping the engine. It is to be appreciated that this embodiment can be operated remotely by replacing switch 110 with a receiver in radio communication with a transmitter. First timer 120, second timer 140, and comparator 170 can be incorporated onto a single integrated circuit for convenience. Current transducer 150 is preferably a low-ohm, high wattage resistor connected in series with starter motor 180. Alternatively, current transducer 150 may be a torroidal Hall Effect sensor that measures the magnetic field created by the current in the conductor to the starter motor from the battery of the vehicle. In either case, current transducer 150 produces a voltage signal that is related to the current drawn by starter motor 180 by being directly proportional to that current.

It will be apparent to those skilled in the art that many modifications and substitutions can be made to the preferred embodiment just described without departing from the spirit and scope of the invention as defined in the appended claims.

What is claimed is:

1. An apparatus for starting an engine having a starter motor, said apparatus comprising:

means in electrical connection with said starter motor for activating said starter motor; and means in electrical connection with said activating means and said starter motor for sensing electrical current drawn by said starter motor, said sensing means including a filter in electrical connection with a transducer, said transducer issuing an analog voltage signal related to said electrical current when sensing said electrical current drawn by said starter motor to said filter, said activating means including comparing means in electrical connection with said filter for comparing the filtered analog voltage signal to a preselected value, said comparing means issuing an output signal when said filtered analog voltage signal is less than or equal to said preselected value.

2. The apparatus as recited in claim 1, wherein said output signal de-energizes said starter motor.

3. The apparatus as recited in claim 1, wherein said activating means issues a de-activating signal and wherein said apparatus further comprises means in electrical connection with said activating means and said starter motor for de-activating said engine in response to receipt of said de-activating signal by said de-activating means from said activating means.

4. The apparatus as recited in claim 1, further comprising:

a transmitter; and a receiver in radio communication with said transmitter and in electrical communication with said activating means, said transmitter transmitting a start signal and a stop signal to said receiver, said receiver passing said start and said stop signals to said activating means, said activating means issuing to said starter motor a second output signal in response to receiving said start signal to energize said starter motor, said activating means issuing a third output signal in response to receiving said stop signal to de-energize said engine.

5. The apparatus as recited in claim 1, wherein said activating means further comprises:

a radio frequency transmitter for sending a start signal;

a radio frequency receiver in radio communication with said radio frequency transmitter, said radio frequency receiver receiving said start signal from said radio frequency transmitter;

a central processing unit in electrical connection with said radio frequency receiver for processing said start signal received by said radio frequency receiver, said central processing unit generating a second output signal in response to receiving said start signal from said radio frequency receiver;

an analog-to-digital converter in electrical connection with said central processing unit and said sensing means for convening said electrical voltage signal to a digital voltage signal for use by said central processing unit;

an input/output port in electrical connection with said central processing unit; and a relay switch in electrical connection with said starter motor and said input/output port, said relay switch having an open position and a closed position, said relay switch energizing said starter motor in said open position and de-energizing said engine in said closed position, said relay switch being switched to said open position by said input/output port in response to receipt by said input/output port of said second output signal from said central processing unit and being switched by said input/output port to said closed position in response to receipt by said input/output port of said output signal from said central processing unit.

6. An apparatus for starting an internal combustion engine, said internal combustion engine having a starter motor, said starter motor drawing an electrical current when energized, said apparatus comprising:

means for issuing a start signal and a stop signal;

means in electrical connection with said issuing means for activating said starter motor, said activating means generating a first output signal to energize said starter motor in response to receipt of said start signal firm said issuing means and generating a second output signal in response to receipt of said stop signal;

means in electrical connection with said activating means and said starter motor for sensing an electrical current drawn by said starter motor, said sensing means further comprising:

transducing means in electrical connection with said starter motor, said transducing means issuing an analog electrical signal when sensing said electrical current in said starter motor;

a filter in electrical connection with said transducing means, said filter filtering high frequencies from said analog electrical signal;

comparing means in electrical connection with said filter for comparing the filtered analog electrical signal to a proselected value, said comparing means issuing said second output signal when said filtered analog electrical signal is less than or equal to said proselected value; and means in electrical connection with said activating means and said starter motor for de-energizing said starter motor in response to receipt of said second output signal from said activating means.

7. The apparatus as recited in claim 6, further comprising indicating means in electrical connection with said activating means for indicating when said activating means has generated said second output signal.

8. The apparatus as recited in claim 6, wherein said de-energizing means de-energizes said magneto when said de-energizing means receives said second output signal from said activating means.

9. The apparatus as recited in claim 6, wherein said activating means further comprises a switch, said switch being in a first position when generating said first output signal and a second position when generating said second output signal.

10. The apparatus as recited in claim 6, wherein said issuing means further comprises:

a switch having a first position and a second position, said switch issuing said start signal when in said first position and said stop signal when in said second position; and timing means in electrical connection with said switch and said activating means for timing said first input signal so that said first output signal is issued for no longer than a predetermined period of time before said second output signal is issued.

11. The apparatus according to claim 6 wherein said activating means is in communication with a magneto.

12. An apparatus for starting an engine having a starter motor, said apparatus comprising:

means for controlling said starter motor, said controlling means activating and deactivating said starter motor in response to signals from a user; and a transducer in electrical connection with said controlling means for sensing electrical current drawn by said starter motor, said transducer issuing an electrical signal to said controlling means related to said electrical current, a filter in electrical communication with said transducer for filtering said electrical signals;

said controlling means deactivating said starter motor when the filtered electrical signal is less than or equal to a proselected value that indicates said engine has started.

13. The apparatus as recited in claim 12, wherein said controlling means includes means for limiting the time said starter motor is activated to a preselected interval of time.

14. The apparatus as recited in claim 12, further comprising:

a transmitter for said user to send a start signal and a stop signal to said controlling means; and a receiver in radio communication with said transmitter for receiving said start and said stop signals from said transmitter, said receiver passing said start and said stop signals to said controlling means.

15. The apparatus as recited in claim 12, wherein said transducer produces an output voltage that is an analog of said electrical current drawn by said starter motor.

16. The apparatus as recited in claim 12, wherein said controlling means further comprises:

means for limiting the time required for said keeping said starter motor activated until said electrical current falls below a preselected value; and means for limiting the time until said starter motor draws an electrical current above a proselected value from when said starter motor is activated by said controlling means.

17. The apparatus as recited in claim 12, further comprising means for indicating that said engine has started.

18. The apparatus as recited in claim 12, further comprising means for indicating that said engine has not started.

19. The apparatus as recited in claim 12, further comprising means for indicating whether said engine has started.

* * * * *